United States Patent [19]

Schwob et al.

[11] 4,324,117

[45] Apr. 13, 1982

[54] JET DEVICE FOR APPLICATION OF LIQUID DYE TO A FABRIC WEB

[75] Inventors: Charles J. Schwob, Dayton; Nicholas Kirbabas, Kettering; Tim Erin, Beavercreek, all of Ohio

[73] Assignee: The Mead Corporation, Dayton, Ohio

[21] Appl. No.: 158,200

[22] Filed: Jun. 11, 1980

[51] Int. Cl.[3] ..... D06B 1/02; B05B 5/08

[52] U.S. Cl. ..... 68/205 R; 239/102; 239/696; 239/698; 346/75

[58] Field of Search ..... 68/205 R; 239/696, 697, 239/698, 699, 102, 566, 690; 346/75

[56] References Cited

U.S. PATENT DOCUMENTS

| | | | |
|---|---|---|---|
| 2,804,764 | 9/1957 | Runton | 68/205 R X |
| 3,230,925 | 1/1966 | Blanz | 118/668 |
| 3,271,102 | 9/1966 | Morgan | 68/205 R X |
| 3,443,828 | 5/1969 | Weber et al. | 68/183 X |
| 3,618,858 | 11/1971 | Culp | 239/696 |
| 3,656,171 | 4/1972 | Robertson | 239/690 X |
| 3,714,928 | 2/1973 | Taylor | 118/624 |
| 3,739,393 | 6/1973 | Lyon et al. | 239/102 X |
| 3,787,881 | 1/1974 | Duffield | 346/75 |
| 4,081,804 | 3/1978 | Van Breemen et al. | 346/75 |

*Primary Examiner*—Philip R. Coe
*Attorney, Agent, or Firm*—Biebel, French & Nauman

[57] ABSTRACT

A jet device for depositing fluid drops upon a moving fluid receiving medium, such as a fabric web, includes a coating head defining a fluid receiving reservoir and including an orifice plate defining a row of orifices which communicate with the fluid receiving reservoir. Fluid is supplied to the reservoir under pressure such that the fluid flows through each of the orifices and emerges therefrom as a fluid filament. The fluid filaments are stimulated to break up into jet drop streams. A charging plate of electrically conductive material defining a charging slot for charging drops formed from the fluid filaments is mounted adjacent and aligned with the coating head means such that the fluid filaments extend into the charging slot of the charging plate and break up of each of the filaments occurs within the slot. Either of first and second electrical charging potentials is controllably applied to the charging plate so as to charge the drops from the jet drop streams or to permit the drops to be formed without carrying an electrical charge. Thereafter, the drops are subjected to an electrostatic field which deflects charged drops, while permitting uncharged drops to pass therethrough and strike the fluid receiving medium. The charging plate is coated with a urethane coating, except in the region of the slot and an adjustable mounting arrangement is provided for precise location of the charging plate.

13 Claims, 4 Drawing Figures

JET DEVICE FOR APPLICATION OF LIQUID DYE TO A FABRIC WEB

BACKGROUND OF THE INVENTION

The present invention relates to a jet device for depositing fluid drops upon a moving fluid receiving medium and, more particularly, to such a device for use in applying precisely controlled quantities of dye to a moving textile or fabric web.

In the textile industry, colored fabric material is typically produced by first weaving or otherwise manufacturing a web of fabric material from uncolored stock and, thereafter, applying a liquid dye to the fabric web. The wet fabric web is then dried to produce the finished colored fabric stock.

In one conventional dyeing technique, fabric web is transported through a bath of liquid dye. Thereafter, excess dye is removed from the web by passing it between a series of squeeze rollers. Dyeing a fabric web in this manner, however, presents several problems. After the dye drenched web passes between the squeeze rollers, the dye tends to migrate through the web fibers, producing uneven accumulation of dye across the web, and thus resulting in non-uniform coloration.

Additionally, since the web passes through a dye bath and absorbs a large quantity of dye per unit area, it is necessary to maintain a relatively diluted dye bath solution. If a higher concentration of dye in the bath solution were to be used, too great a quantity of dye would be applied per unit area of the web. Since, however, a substantial quantity of liquid is absorbed by the web as it passes through the dilute dye bath, this liquid must be removed thereafter from the web in a drying process, typically by application of heat energy to the web. As will be appreciated, such a drying operation is costly, since substantial amounts of energy are required.

Another dyeing technique for fabric webs which has been utilized in the past is to spray liquid dye from one or more spray nozzles onto the moving web. U.S. Pat. No. 3,271,102, issued Sept. 6, 1966, to Morgan, shows a spray apparatus for dyeing pile carpeting. An arrangement is described in which the fabric web is transported around a relatively sharp corner, thus opening the pile to permit all portions of the pile to receive the liquid dye.

U.S. Pat. No. 2,532,471, issued Dec. 5, 1950, to Wedler, discloses a similar spray applicator in which liquid dye is applied to a fabric web by means of a plurality of spray nozzles positioned in a spray chamber through which the web passes. After passing through several subsequent treatment chambers, the dyed web is transported through a drying chamber in which the fabric is dried by means of hot air jets.

Finally, U.S. Pat. No. 2,804,764, issued Sept. 3, 1957, to Runton, discloses an apparatus for dyeing a yarn sheet which is to be wound on a warp beam for use on a velvet loom. A plurality of separate spray nozzles are positioned in a series of rows which are inclined with respect to the direction of movement of the yarn sheet. The nozzles may be individually controlled to form a desired pattern on the yarn sheet. The sheet is then passed under a dryer, such as a bank of infrared lamps, to dry and set the dye. While permitting the application of a higher concentration dye solution to the web such that the amount of subsequent drying is reduced than techniques in which the web is dipped in a dye bath, the Morgan, Wedler, and Runton dye spraying devices are somewhat limited in that the amount of dye applied to the web per unit length can be controlled with less precision than is desired. Additionally since the spray nozzles provide a relatively constant spray of fluid dye, fluctuations in the speed of movement of the web result in uneven application of dye to the web.

U.S. Pat. No. 3,443,878, issued May 13, 1969, to Weber et al, discloses a device for continuously dyeing a textile web in which a more precisely controlled by application of dye to the fabric web may be obtained. One embodiment of the Weber et al 3,443,878 device utilizes an air jet which deflects a stream of dye produced by a nozzle such that the dye is controllably applied to the web. A number of such nozzles and air jets may be provided. In another embodiment, air nozzles are utilized to deflect portions of a curtain of liquid dye onto the web which moves past the curtain. Although the Weber et al 3,443,878 patent mentions that dye streams may be deflected by a force field other than that produced by an air nozzle (such as an electromagnetic or electrostatic field), all of the embodiments disclosed in the Weber et al patent utilize air nozzles for stream deflection. While the Weber et al disclosure teaches a dye spraying technique in which intermittent spraying can be accomplished at relatively high speed, the Weber et al device, like the other spray dyeing devices discussed previously is limited in the uniformity with which dye may be applied to the textile web. Additionally, since the spray nozzles of the Weber et al device are operated in a binary manner, that is, either "on" or "off", the Weber et al device does not enable the amount of liquid dye deposited on the fabric web to be with acceptable precision.

Accordingly, it is seen that there is a need for a jet device for depositing fluid, such as dye, on a moving fluid receiving medium in which the number and positioning of the drops so deposited may be controlled precisely.

SUMMARY OF THE INVENTION

An ink jet device for depositing fluid drops upon a moving fluid receiving medium includes coating head means defining a fluid receiving reservoir and including an orifice plate defining a plurality of orifices which are arranged in a row and which communicate with the fluid receiving reservoir. A means for supplying fluid under pressure to the fluid receiving reservoir is provided such that fluid flows through each of the orifices and emerges therefrom as a fluid filament. A means for stimulating each of the fluid filaments is provided to cause each of the fluid filaments to break up into a jet drop stream of fluid drops. Each of the jet drop streams is directed generally toward the fluid receiving medium.

A charging means, including a charging plate of electrically conductive material defining a charging slot, charges drops formed from the fluid filaments. The charging means is mounted adjacent and aligned with the coating head means such that fluid filaments extend into the charging slot of the charging plate, and break up of each of the filaments occurs within the slot.

A means is provided for controllably applying either of first and second electrical potentials to the charging plate. The first electrical potential is equal to the electrical potential of fluid in the reservoir, while the second electrical potential differs substantially from the electrical potential of the fluid in the reservoir. Drops in the jet drop streams which are formed as the second electrical potential is applied to the charging plate carry electrical charges, while drops formed as the first electrical potential is applied to the charging plate are uncharged. A deflection and catching means provides a drop deflecting electrical field through which the jet drop streams pass such that drops are deflected thereby and, further, provide for catching selected ones of the drops or permitting others of the drops to strike the fluid receiving medium. The first electrical potential and the potential of the fluid in the reservoir may be substantially equal to ground potential.

The charging plate may be formed of brass with an electrically nonconductive coating on its surface, which coating surrounds the charging slot but does not cover the plate within the slot. The electrically nonconductive coating may comprise a urethane coating.

The means for mounting the charging means may comprise means for attaching the charging means to the coating head. This means may further include means for adjusting and aligning the charging means with respect to the coating head. The charging plate may comprise first and second raised pedestal portions on a first side of the charging slot defining first and second positioning surfaces, respectively, with the first positioning surface being substantially conical in shape and the second positioning surface being substantially V-shaped. The charging plate may further comprise third and fourth raised pedestal portions on a second side of the charging slot, opposite the first side. The third and fourth raised pedestal portions define third and fourth positioning surfaces, respectively, which are substantially flat.

The means for adjusting and aligning the position of the charging means with respect to the coating head means may comprise means, mounted on the coating head means, defining first, second, third and fourth generally spherical surfaces for contacting the first, second, third and fourth positioning surfaces, respectively. The means for mounting the charging means may further comprise threaded bolts extending through the charging plate and engaging the coating head means, whereby the positioning surfaces are held against associated ones of the generally spherical surfaces.

Accordingly, it is an object of the present invention to provide a jet device for depositing fluid drops upon a moving fluid receiving medium in which a plurality of jet drop streams are directed generally toward the fluid receiving medium, with drops in the jet drop streams being charged and deflected such that a portion of the drops may be caught; to provide such a jet device in which the jet drop streams are positioned in a row and in which the drops are charged by application of an electrical potential to a charging plate of electrically conductive material defining a charging slot; to provide such a jet device in which the charging plate includes an electrically nonconductive coating on its surface, which coating surrounds the slot but does not cover the plate within the slot; and to provide such a jet device in which the charging plate is appropriately mounted for adjustment and alignment with respect to the jet drop streams.

Other objects and advantages of the invention will be apparent from the following description, the accompanying drawings and the appended claims.

DETAILED DESCRIPTION OF THE PREFERRED EMBODIMENTS

Figure 1:
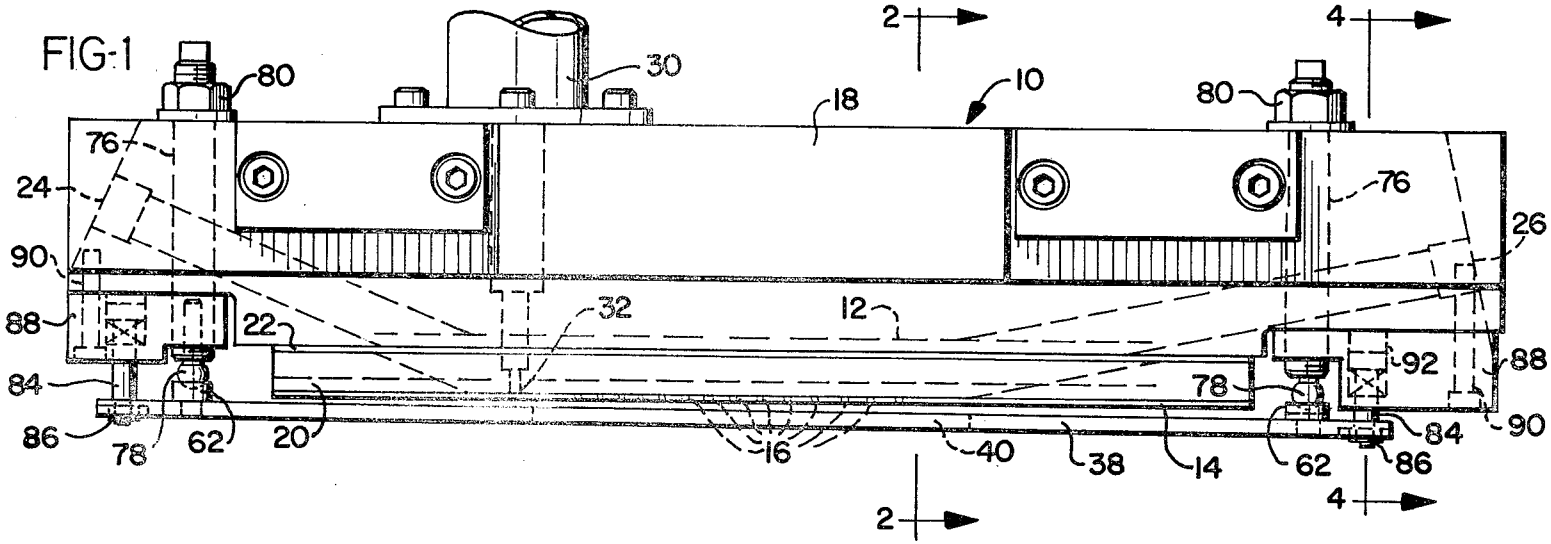
FIG. 1 is a front elevational view illustrating the coating head and charging plate of the jet device of the present invention.
Figure 2:
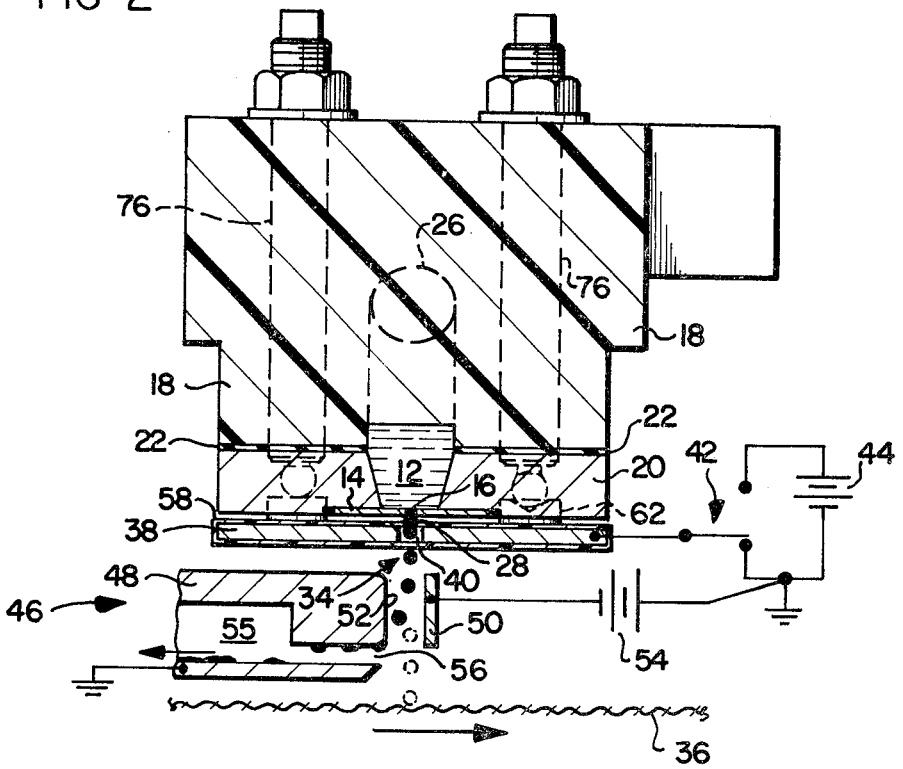
FIG. 2 is a sectional view taken generally along line 2—2 in FIG. 1, further illustrating the means for deflecting and catching drops from the jet drop streams.

Reference is made to FIGS. 1 and 2 of the drawings which illustrate a jet device constructed according to the present invention. The jet device includes a coating head means 10 defining a fluid receiving reservoir 12 and including an orifice plate 14 defining a plurality of orifices 16 communicating with the reservoir 12. As seen in FIG. 1, orifices 16 are arranged generally in a row extending along the length of coating head 10. Coating head 10 includes an upper manifold block 18 and an orifice plate holder 20 with gasket 22 positioned therebetween. The upper manifold block 18 is preferably formed of an electrically nonconductive material, such as plastic. Orifice plate holder 20 and upper manifold block 18 may be secured together by means of screws (not shown) and together define the fluid receiving reservoir 12, as well as a fluid inlet opening 24 and fluid outlet opening 26. Valved inlet and outlet lines are connected to openings 24 and 26 such that the fluid flow through the fluid reservoir 12 may be controlled. Typically, during operation of the jet device of the present invention, the valve communicating with outlet opening 26 is closed, while the valve communicating with inlet opening 24 is open such that liquid dye is supplied under pressure to the fluid receiving reservoir 12. When this occurs, the fluid flows through each of the orifices 16 and emerges therefrom as a fluid filament 28.

Orifice plate 14 is formed of a flexible metal material, such as berylium copper, and is adhesively fastened around its periphery to the lower surface of orifice plate holder 20 in a fluid-tight seal. A piezoelectric transducer 30 is mounted on upper manifold block 18 and includes a stimulator tip 32 which extends downward through the reservoir 12 to contact the orifice plate 14 adjacent one end thereof. When electrically energized, piezoelectric transducer 30 vibrates the orifice plate 14 such that a series of bending waves are caused to travel along the orifice plate. The bending waves pass the length of the reservoir 12 and, as a consequence, each point along the orifice plate is repetitively flexed upward and downward. This bending of the orifice plate 14, as described in U.S. Pat. No. 3,739,393, issued June 12, 1973, to Lyon et al, stimulates each of the fluid filaments to cause the fluid filaments to break up into jet drop streams 34 of fluid drops. Each of the jet drop streams, as shown in FIG. 2, is directed generally toward a fluid receiving medium 36, such as a moving web of fabric material.

A charging means, including a charging plate 38 of electrically conductive material is provided for charging drops formed from the fluid filaments 28. The charging plate 38 generally defines a charging slot 40. A means for mounting the charging plate adjacent and aligned with the coating head means 10 is provided such that the fluid filaments 28 extend into the charging slot 40 of the charging plate 38 and break up of each of the filaments 28 occurs within the slot 40.

A switch 42 is electrically connected to charging plate 38. When switch 42 is in its lower switching state, as illustrated, the switch applies a first electrical potential equal to the electrical potential, of the fluid in reservoir 12, to the charging plate 38. When switch 42 is switched into its upper switching position, the switch applies a second electrical potential to the charging plate 38, which potential differs substantially from the electrical potential of the fluid in the reservoir 12. In the illustrated device, the fluid within the reservoir 12 is maintained at ground potential. This is generally preferable since many components in the liquid dye supply system typically are made of metal and are grounded. The liquid dye within reservoir 12 may therefore be conveniently grounded through the fluid supply system which supplies the reservoir 12 with liquid dye under pressure.

When the switch 42 is switched into its lower switching state, both the charging plate 38 and the fluid within reservoir 12 are maintained at the same electrical potential. Therefore, the drops which are formed from the tip of filament 28 carry no electrical charge. In contrast, however, when switch 42 is switched into its upper switching position, a positive electrical potential from voltage source 44 is applied to the charging plate 38. This positive potential induces a corresponding negative charge on the tips of the fluid filaments 28. As drops are formed from the fluid filament tips, they carry away a portion of this negative electrical charge. Thus, by actuating switch 42 between its switching state, the drops produced by the coating head means 10 may be charged or uncharged, as desired.

As seen in FIG. 2, a deflection and catching means 46, including an electrically conductive drop catcher 48 and an electrically conductive deflection electrode 50, provides a drop deflecting electrical field through which the jet drop streams pass. Means 46 is not shown in FIG. 1 for purposes of clarity. It will be appreciated that the catcher 48 and the deflection electrode 50 extend generally the entire length of the jet device beneath the coating head 10. Deflection electrode 50 extends substantially parallel to the row of jet drop streams produced by the coating head. The catcher 48 likewise defines a drop catching surface 52 which extends along the row of jet drop streams parallel, thereto. The electrical deflection field is produced by supplying a negative potential from voltage source 54 to the deflection electrode 50, while electrically grounding catcher 48. It will be appreciated, therefore, that drops from the jet drop streams 34 which are uncharged pass downward between the deflection electrode 50 and the catcher 48 and strike the fabric web 36, while drops in the jet drop streams 34 which carry a negative electrical charge are deflected by the electrostatic field toward the surface 52 such that they strike the surface. The drops on surface 52 thereafter flow downward along the surface and are ingested into manifold 55 within catcher 48 via slot 56. The fluid within manifold 54 is removed by a suction source which maintains a partial vacuum within the manifold 55.

Figure 3:
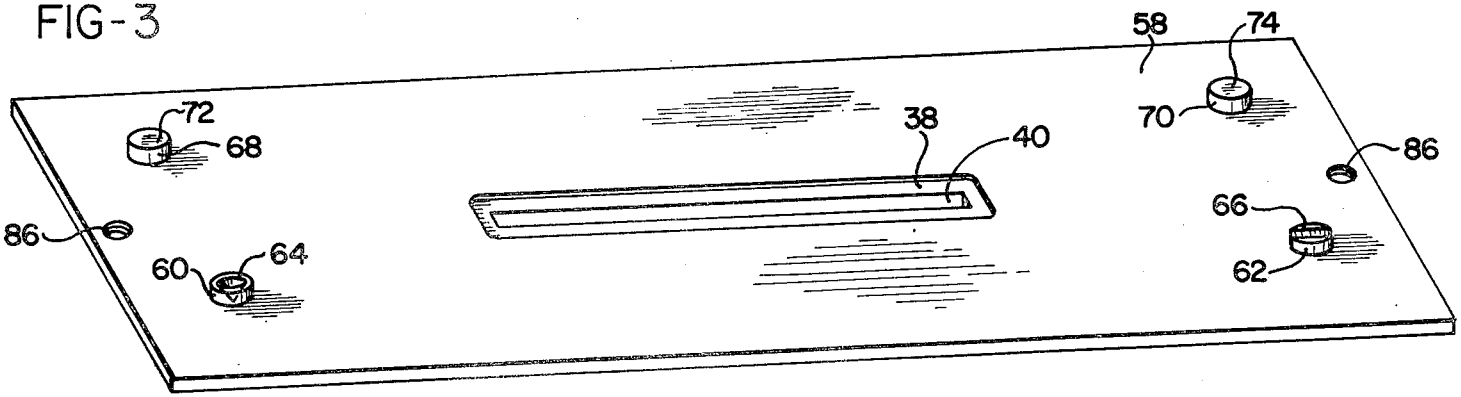
FIG. 3 is a perspective view of the charging plate used in the present invention.

The charging plate 38 may preferably be formed of brass with an electrical nonconductive coating 58 which, as seen in FIG. 3, surrounds the slot 40 but does not cover the charging plate within the slot. This electrically nonconductive coating 58 comprises a layer of urethane which may be sprayed onto the surface of plate 38 with appropriate masking of the slot 40. Coating 58 is advantageous in that, to some degree, it insulates the plate 38 from the surrounding elements of the jet device. As a consequence, when switch 42 is switched into its upper switching state and an electrical potential supplied to the plate, the coating 58 prevents the electrically conductive fluid dye from shorting the plate 38 to ground, in the event that fluid drops may have collected on the surface of the plate.

As can be seen in FIG. 3, the charging plate 38 comprises first and second raised pedestal portions 60 and 62 which are positioned on a first side of charging slot 40. The first raised pedestal portion 60 defines a first positioning surface 64 which is substantially conical in shape. The second raised pedestal portions 62 defines a second positioning surface 66 which is substantially V-shaped. Third and fourth raised pedestal portions 68 and 70 are positioned on a second side of the charging slot 40, opposite the first side. The third and fourth raised pedestal portions 68 and 70 define third and fourth positioning surfaces 72 and 74, respectively, which surfaces are substantially flat.

As shown in FIGS. 1 and 2, raised pedestal portions 60, 62, 68 and 70 cooperate with bolts 76 which are threaded into openings within support blocks 88. Each of the bolts 76 includes a head 78 which defines a generally spherical surface for contacting a respective one of the positioning surfaces 64, 66, 72, and 74. Bolts 76 are fixed in place by means of locking nuts 80.

Figure 4:
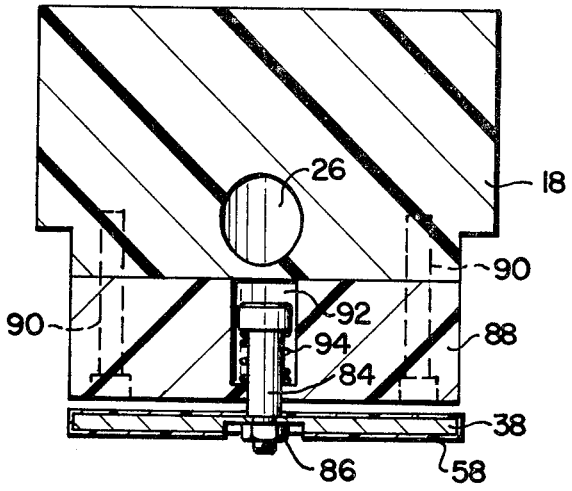
FIG. 4 is a sectional view taken generally along line 4—4 in FIG. 1.

The positioning surfaces on the raised pedestal portions of the charging plate 38 are urged by bolts 84 upward into contact with the mating spherical surfaces defined by bolt heads 78. Bolts 84 extend downward from the coating head 10 through holes 86 in the charging plate 38. As seen in FIG. 4, bolts 84 are engaged by nuts 86 beneath the charging plate 38. Bolts 84 are held by support blocks 88, which blocks are secured to the upper manifold block 18 by bolts 90. The heads of bolts 84 are received within recesses 92 in support blocks 88. Bolts 84 are urged upward by compression springs 94 such that the pedestal portions 60, 62, 68, and 70 are brought into contact with spherical surfaces 78 without the danger of stressing charging plate 38 by tightening nuts 86 excessively.

As will be appreciated, it is important to align the charging slot 40 precisely with the row of orifices 16 such that the breakup of the fluid filaments 28 occurs within the charging slot 40. The position and orientation of the slot 40 with respect to the substantially conical positioning surface 64 is precisely defined during manufacture of the charging plate 38. Similarly, the location of the mating spherical surface 78 with respect to the row of orifices 16 is precisely defined during assembly of the coating head 10. As a consequence, when the spherical surface is received within the conical indentation in pedestal 60, and, further, when the spherical surface 78 contacts the V-shaped surface 66 in pedestal portion 62, the slot 40 is precisely aligned with the orifices 16. Pedestal portions 68 and 70 are provided to stabilize the charging plate 38, as well as to determine precisely the spacing between the charging plate 38 and the orifice plate 14.

As indicated previously, it is important that formation of the drops from the fluid filament tips occurs within the slot. With traveling wave stimulation of the orifice plate 14, the amplitude of the bending waves tends to diminish as the waves travel along the plate, thus resulting in progressively longer fluid filaments along the length of the coating head. It may be desired, therefore, to tilt the charging plate 38 slightly such that the plate 38 is slightly further from the orifice plate 14 adjacent the end of the orifice plate opposite the transducer 30 than at the end adjacent transducer 30. This adjustment is made by changing the position of bolts 76 in support blocks 88.

It will be appreciated that by utilizing jet drop techniques according to the present invention, drops of liquid dye may be deposited on a fabric web with exceptionally precise control as to the amount of dye applied per unit area and as to the uniformity of application of the dye to the web. If, for instance, it is determined that four drops of dye are to be deposited upon a fabric web by each jet drop stream every 0.02 inches, a tachometer arrangement connected to the transport for the fabric web 36 may provide a tachometer pulse after each 0.02 inches of movement of the web. Upon receipt of each tachometer pulse, switch 42 is switched into its lower switching position for a period of time sufficient for four uncharged drops to be formed. These drops pass downward, unaffected by the electric deflection field, and are deposited on the web of fabric material 36. Subsequently, the switch 42 is returned into its upper switching position until receipt of the next successive tachometer pulse. It will be appreciated that switch 42 may comprise a semiconductor switching circuit, if desired. Thus, it can be seen that a precisely controlled quantity of liquid dye can be applied to a moving fabric web by the present invention, while ensuring that the application of dye to the web is exceptionally uniform.

While the forms of apparatus herein described constitute preferred embodiments of the invention, it is to be understood that the invention is not limited to these precise forms of apparatus, and that changes may be made therein without departing from the scope of the invention.

What is claimed is:

1. A jet device for depositing fluid drops upon a moving fluid receiving medium, comprising coating head means defining a fluid receiving reservoir and including an orifice plate defining a plurality of orifices communicating with said fluid receiving reservoir, said orifices being arranged in a row, means for supplying fluid under pressure to said fluid receiving reservoir such that fluid flows through each of said orifices and emerges therefrom as a fluid filament, means for stimulating each of said fluid filaments to cause said fluid filaments to break up into jet drop streams of fluid drops, each of said jet drop streams being directed generally toward said fluid receiving medium, charging means, including a charging plate of electrically conductive material defining an elongated charging slot, for charging drops formed from said fluid filaments, means for mounting said charging means adjacent and aligned with said coating head means such that said slot is substantially parallel to said row, and such that said fluid filaments extend into said charging slot of said charging plate and break up of each of said filaments occurs within said slot, means for controllably applying either of first and second electrical potentials to said charging plate, said first electrical potential being equal to the electrical potential of fluid in said reservoir and said second electrical potential differing substantially from the electrical potential of fluid in said reservoir, whereby said drops in said jet drop streams formed as said second electrical potential is applied to said charging plate carry electrical charges, while said drops formed as said first electrical potential is applied to said charging plate remain uncharged, and deflection and catching means for providing a drop deflecting electrical field through which said jet drop streams pass such that drops are deflected thereby, and for catching selected ones of said drops while permitting others of said drops to strike said fluid receiving medium.

2. The jet device of claim 1 in which said first electrical potential is substantially equal to ground potential.

3. The jet device of claim 1 in which said charging means comprises a charging plate formed of brass.

4. The jet device of claim 3 in which said charging plate includes an electrically nonconductive coating on its surface, which coating surrounds said slot but does not cover said plate within said slot.

5. The jet device of claim 4 in which said electrically nonconductive coating comprises a urethane coating.

6. The jet device of claim 1 in which said means for mounting said charging means comprises means for attaching said charging means to said coating head.

7. The jet device of claim 6 in which said means for attaching said charging means to said coating head includes means for adjusting and aligning said charging means with respect to said coating head.

8. The jet device of claim 7 in which said charging plate comprises first and second raised pedestal portions on a first side of said charging slot defining first and second positioning surfaces, respectively, said first positioning surface being substantially conical in shape and said second positioning surface being substantially V-shaped, and third and fourth raised pedestal portions on a second side of said charging slot opposite said first side, said third and fourth raised pedestal portions defining third and fourth positioning surfaces, respectively, which are substantially flat.

9. The jet device of claim 8 in which said means for adjusting and aligning the position of said charging means with respect to said coating head means comprises means, mounted on said coating head means, defining first, second, third and fourth generally spherical surfaces for contacting said first, second, third and fourth positioning surfaces, respectively.

10. The jet device of claim 9 in which said means for mounting said charging means further comprises bolts extending through said charging plate and engaging said coating head means, whereby said positioning surfaces are held against associated ones of said generally spherical surfaces.

11. A jet drop charging device for controllably charging drops formed from a plurality of fluid filaments produced by a jet coating head, said fluid filaments being arranged in a row, comprising a charging plate of electrically conductive material defining an elongated slot into which said fluid filaments extend, whereby said drops are formed from said fluid filaments within said slot, said charging plate being coated with an electrically non-conductive material on its surface and said slot being free of said non-conductive material, and means for applying an electrical charge potential to said charging plate, whereby electrical charges are induced in the tips of said fluid filaments and are carried away by drops formed therefrom.

12. The jet drop charging device of claim 11 in which said charging plate is formed of brass.

13. The jet drop charging device of claim 12 in which said electrically non-conductive material consists of urethane.

* * * * *